US010701994B2

(12) United States Patent
Raines

(10) Patent No.: US 10,701,994 B2
(45) Date of Patent: Jul. 7, 2020

(54) PERSPIRATION REDIRECTING BAND

(71) Applicant: Mark Thomas Raines, Austin, TX (US)

(72) Inventor: Mark Thomas Raines, Austin, TX (US)

(73) Assignee: Mark Thomas Raines, Austin, TX (US)

( * ) Notice: Subject to any disclaimer, the term of this patent is extended or adjusted under 35 U.S.C. 154(b) by 0 days.

(21) Appl. No.: 15/587,398

(22) Filed: May 4, 2017

(65) Prior Publication Data

US 2018/0146726 A1 May 31, 2018

Related U.S. Application Data

(60) Provisional application No. 62/303,997, filed on Mar. 4, 2016.

(51) Int. Cl.
*A41D 20/00* (2006.01)
*A41D 17/00* (2006.01)
(Continued)

(52) U.S. Cl.
CPC ..... *A41D 20/00* (2013.01); *A41D 17/00* (2013.01); *A41D 19/0044* (2013.01)

(58) Field of Classification Search
CPC .... A41D 20/00; A41D 13/00; A41D 13/0015; A41D 13/088; A41D 19/0089;
(Continued)

(56) References Cited

U.S. PATENT DOCUMENTS 5,150,475 A * 9/1992 Hansen ..... A41D 13/088 2/16
5,329,638 A * 7/1994 Hansen ..... A41D 13/088 2/16

(Continued)

*Primary Examiner* — Robert H Muromoto, Jr.
(74) *Attorney, Agent, or Firm* — John A. Fortkort; Fortkort & Houston PC

(57) ABSTRACT

A wearable device is provided which redirects perspiration away from a user's hands, feet and other extremities. The device may be fashioned as a band which is equipped with a channel structure extending around the entire surface of the band. The channel structure includes a channel base and a channel lip. The channel structure forms a perspiration channel with a flared lip. The channel base has a first thickness $T_c$ at a central portion thereof, and a second thickness $T_e$ at end portions thereof, wherein $T_e<T_c$. The channel base slopes from the central portion downward toward the end portions thereof, transitioning from the first thickness $T_c$ to the second thickness $T_e$. In some embodiments, the device is equipped with at least one pointed tip which directs the flow of perspiration away from the user's extremities. In some embodiments, when the device is not being used as a perspiration deflector, it may be used as a flying toy which can be thrown and caught.

18 Claims, 17 Drawing Sheets

(51) Int. Cl.
*A41D 19/00* (2006.01)
*A41D 13/08* (2006.01)

(58) Field of Classification Search
CPC ..... A41D 2400/20; A41D 13/087; A41D 19/0044; A41D 19/01582; A41D 20/005; A41D 2400/60; A41D 27/28
See application file for complete search history.

(56) References Cited

U.S. PATENT DOCUMENTS 5,404,591 A * 4/1995 Brinnand ..... A41D 13/088 2/161.1
5,708,979 A * 1/1998 Redwood ..... A63B 71/146 2/161.1
5,940,885 A * 8/1999 Matthews ..... A45D 44/12 2/174
7,398,559 B2 * 7/2008 Flatt ..... A42C 5/02 2/174
8,112,820 B2 * 2/2012 Johnson ..... A41D 19/0089 2/160
8,863,312 B1 * 10/2014 Gary ..... A41D 19/01547 2/20
8,887,315 B2 * 11/2014 Boynton ..... A61F 5/026 2/24
9,021,613 B2 * 5/2015 Niemeyer ..... A41D 20/00 2/16
10,039,424 B2 * 8/2018 Bank ..... A47K 7/03
2002/0165474 A1 * 11/2002 Chiang ..... A61F 5/0104 602/26
2003/0221241 A1 * 12/2003 Rivera ..... A41D 20/005 2/170
2010/0022361 A1 * 1/2010 Raines ..... A63B 21/06 482/93
2010/0267525 A1 * 10/2010 Tanner ..... A41D 13/0015 482/74
2011/0016610 A1 * 1/2011 Wieder ..... A41D 20/00 2/170
2013/0110264 A1 * 5/2013 Weast ..... G06F 19/3481 700/91
2014/0298561 A1 * 10/2014 Niemeyer ..... A41D 13/00 2/69
2015/0152578 A1 * 6/2015 Darby ..... D04B 1/243 66/171
2015/0164672 A1 * 6/2015 Boynton ..... A61F 5/026 602/19
2015/0259110 A1 * 9/2015 Blackburn ..... B65D 50/00 222/153.14
2015/0264988 A1 * 9/2015 Niemeyer ..... A41D 13/00 2/16
2018/0146726 A1 * 5/2018 Raines ..... A41D 19/0044

* cited by examiner

PERSPIRATION REDIRECTING BAND

CROSS-REFERENCE TO RELATED APPLICATIONS

This application claims the benefit of U.S. Provisional Application No. 62/303,997, filed Mar. 4, 2016, entitled "Perspiration Redirecting Band Device And Flying Wrist Disc", which is incorporated herein by reference in its entirety.

FIELD OF THE DISCLOSURE

The present disclosure relates generally to athletic accessories, and more particularly to wearable devices which redirect perspiration.

BACKGROUND OF THE DISCLOSURE

Athletes frequently encounter issues with sweaty, slippery hands during sporting events, especially in high temperature, high humidity environments. This issue is particularly problematic in sports which require a good grip, such as volleyball, basketball, football, ultimate Frisbee and tennis.

Various devices have been developed in the art to address the foregoing issue. These include the ubiquitous sweatband, which was invented by designer Fred Perry in the late 1940s. Sweatbands are typically made of a towel-like terrycloth material. Other devices fashioned as perspiration absorbing bands include the sweatband described in U.S. Pat. No. 5,146,630 (Richard), the sports wristband described in CN 203915250 (Ting), and the sweat managing first-band described in U.S. 2014/0173806 (Fournier).

Various headbands have also been developed in the art to redirect sweat originating from the user's head. Examples include those found in U.S. Pat. No. 7,398,559 (Flatt), entitled "Perspiration Redirecting Head Band Device"; U.S. Pat. No. 4,626,247 (Frankel), entitled "Sweat Collecting Headband"; U.S. Pat. No. 5,781,932 (Brown), entitled "Forehead Perspiration Collector/Discharger"; U.S. Pat. No. 6,971,122 (Sanchez), entitled "Sweat Diversion Band"; U.S. Pat. No. 4,638,512 (Frankel), entitled "Sweat Collecting Headband"; U.S. Pat. No. 5,740,556 (Brown), entitled "Forehead Perspiration Collector/Discharger"; U.S. Pat. No. 6,353,936 (Flatt), entitled "Perspiration Redirecting Head Band Apparatus"; and U.S. Pat. No. 7,398,559 (Flatt), entitled "Perspiration Redirecting Head Band Device".

SUMMARY OF THE DISCLOSURE

Figure 1A:
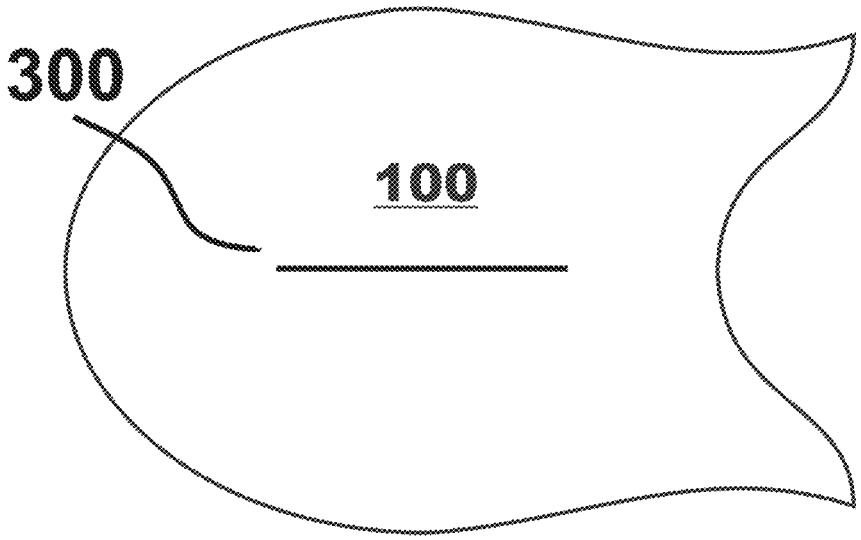
FIGS. 1A and 1B are top views, respectively, of first (A) and second (B) embodiments of a wrist band device in accordance with the teachings herein.

This section provides a general summary of the present disclosure, and is thus not intended to be a comprehensive disclosure of the full scope of the features of the devices and methodologies disclosed herein.

In one aspect, a wearable device is provided for redirecting perspiration away from the body of a user. The device comprises (a) a non-moisture absorbent, elastomeric body having first and second opposing major surfaces and having a central aperture defined therein; (b) a first protrusion extending from said elastomeric body, said protrusion having a first longitudinally extending channel defined therein; and (c) a second, annular channel which is defined in said first major surface and which intersects said first channel.

In another aspect, a method is provided for redirecting perspiration away from the body of a user. The method comprises providing a device comprising (a) a non-moisture absorbent, elastomeric body having first and second opposing major surfaces and having a central aperture defined therein, (b) a first protrusion extending from said elastomeric body, said protrusion having a first longitudinally extending channel defined therein, and (c) a second, annular channel which is defined in said first major surface and which intersects said first channel; and placing the device on the limb of the user such that the user's limb extends through the central aperture.

DETAILED DESCRIPTION

While a small portion of the population suffers from excessively sweaty palms (1% of the population has palmar hyperhidrosis), most of the sweat that ends up on an athlete's hands actually originates from the athlete's armpits and arms. In fact, it has been found that approximately 80% of the water that reaches an athlete's palms actually originates from above the wrist.

When an athlete is in a stationary position with their hands at their sides, sweat from the athlete's arms to stream down the pinky-side and middle of their palm, where it runs off of the pinky and ring fingers. However, when an athlete is swinging their arms or gripping a sporting implement (such as, for example, a tennis racket), the sweat from the athlete's armpits and arms tends to splash over their entire palm. While a small amount of moisture may actually improve an athlete's grip, excessive moisture may result in hydroplaning, which the athlete experiences as a slippery grip.

Many athletes utilize hand towels and other such implements to remove sweat from their hands. While the use of such implements may remove excess moisture, the result is usually temporary, and the athlete's hands may quickly become slippery again. Moreover, the use of such implements is reactionary, rather than proactive. Hence, in typical use, an athlete experiences a compromised grip before turning to these implements, which may put the athlete at a competitive disadvantage.

The various sweatbands developed in the prior art may provide a partial solution to this problem. However, conventional sweatbands are made from moisture absorbing materials, and are hence prone to fabric saturation. In particular, once the absorbing band becomes saturated, it resists the absorption of additional moisture. Consequently, any additional moisture will bypass the band. Moreover, if the saturated band is compressed, it will release moisture in the direction of gravity which, in the case of a performing athlete, will frequently be in the direction of the hands or face.

Once saturated with moisture, perspiration absorbing bands may also act as thermally insulating devices on such areas of the body. Unfortunately, these devices are commonly worn on the wrist or forehead, which are points of the body that would otherwise act as heat dispersal locations. Consequently, the use of these devices may contribute to heat strain on the user's body. Perspiration absorbing bands also require frequent laundering, because they readily soak up moisture and dirt, and may develop an unpleasant odor.

It has now been found that some or all of the foregoing issues may be addressed with the various devices and methodologies disclosed herein. In a preferred embodiment, these devices take the form of a non-porous, non-moisture absorbing band which is suitably contoured to deflect sweat away from the body. Thus, for example, in some embodiments, the band is implemented as a wristband which deflects (rather than absorbs) sweat before it passes the wrist. As a result, the amount of sweat reaching a user's palms may be significantly reduced. The use of such a band allows an athlete to proactively address the foregoing issues before they effect the athlete's performance.

In a preferred embodiment, the device disclosed herein may be contoured to essentially act as a sweat receptacle which can hold and retain fluid. The trapped fluid remains in the device until dislodged by the motion of the user. For example, if the device is a wristband, the fluid may remain trapped in the device until the user moves their arm in a particular way. At that point, the motion of the user's arm effectively ejects the trapped fluid from the device, flinging it away from the user's body.

Moreover, because the device is nonabsorbent, it does not suffer from the various issues arising from moisture saturation in prior art sweat bands. In particular, because the device is moisture deflecting (rather than moisture absorbing), the performance of the device does not decline during use (due, for example, to moisture absorption), and the device also does not require laundering (it may be readily cleaned by briefly rinsing it in water).

In some embodiments, the devices disclosed herein may be used in conjunction with a glove. In such embodiments, the device prevents sweat from entering the glove, thus keeping the glove drier.

In some embodiments, the devices disclosed herein may be suitably contoured to permit its use as a wipe or squeegee for the purpose of removing sweat from the user's body. For example, in some embodiments, the device may be implemented as a wristband with a suitably contoured surface that permits its use in wiping or squeegeeing sweat from the user's brow. This has the beneficial effect of keeping sweat out of the user's eyes.

In some embodiments, the devices disclosed herein may be further usable (when it is not being worn) as a toy. In particular, because the device is generally annular in shape, it may be configured for use as a flying disc, saucer or other aerodynamic toy when it is not being worn.

Figure 1B:
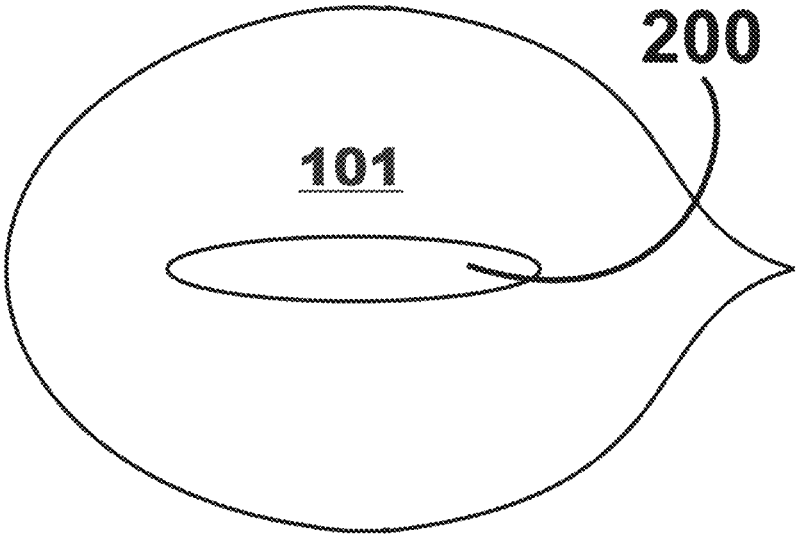

FIG. 1A illustrates a first particular, non-limiting embodiment of a device in accordance with the teachings herein. The device 101*a* depicted therein is a sweat deflector/channeling device comprising an elastomeric body 103*a*. The elastomeric body 103*a* is equipped with a central aperture 105*a* or slit through which a user's hand may be inserted to permit the device 101*a* to be mounted on the wrist of the user. In some embodiments, the central aperture 105*a* may be equipped with a fabric lining. The sweat deflector/channeling device 101*a* of FIG. 1A is further equipped with twin tails 107*a* or sweat dischargers, which allows perspiration to be channeled to, and ejected from, the tips thereof when the device is worn with the tails 107*a* facing away from the user's thumb. The device 101*b* of FIG. 1B is similar in design and function, but is equipped with a single tail 107*b*.

Figure 2A:
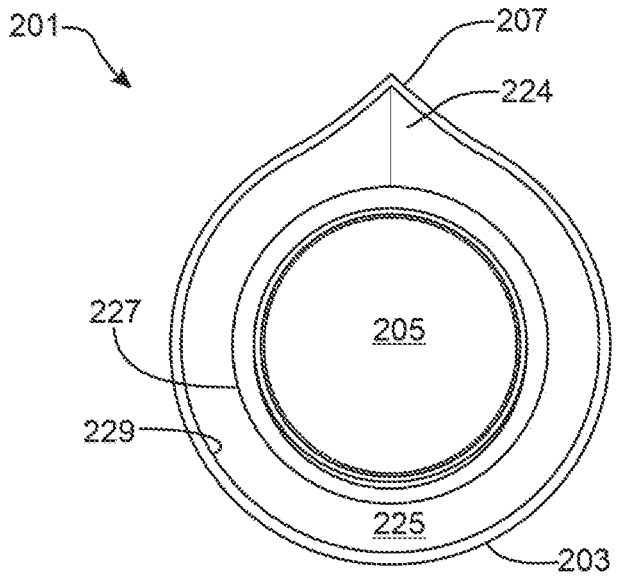
FIGS. 2A and 2B are, respectively, top and bottom views of a third embodiment of a wrist band device in accordance with the teachings herein.
Figure 2B:
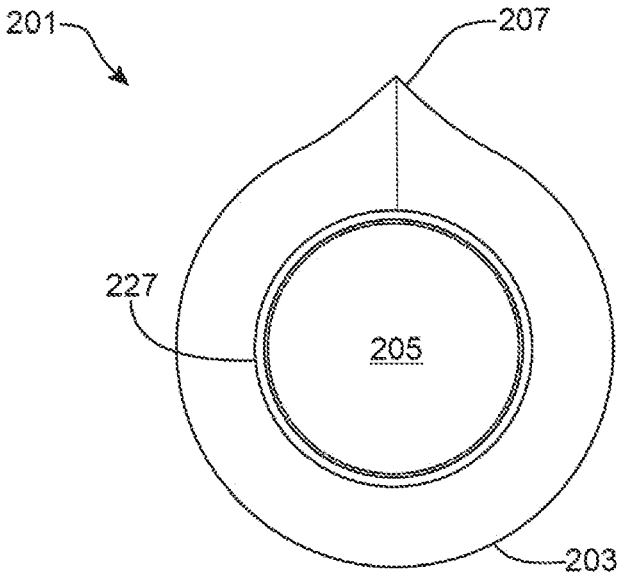

FIGS. 2A and 2B illustrate a second particular, non-limiting embodiment of a device in accordance with the teachings herein. The device 201 depicted therein is a sweat deflector/channeling device comprising an elastomeric body 203. The elastomeric body 203 has first and second opposing major surfaces, and is equipped with a central aperture 205 through which a user's hand may be inserted to permit the device 201 to be mounted on the wrist of the user. In some embodiments, the central aperture 205 may be equipped with a fabric lining or flexible lip to fill any gaps between the device and the wrist of the user as may occur when the wrist is flexing (and thus, not perfectly round or oval). The sweat deflector/channeling device 201 of FIGS. 2A and 2B is further equipped with a protrusion 207 or tail which acts as a sweat discharger by allowing perspiration to be channeled to, and ejected from, the tips thereof when the device is worn with the tail 207 facing away from the user's thumb.

The top view of FIG. 2A of the device 201 illustrates the protrusion 207 to which perspiration generally is channeled prior to discharge. As seen therein, the protrusion 207 is equipped with a first, longitudinally extending channel 224 which intersects with a second, annular channel 225 defined in a first major surface of the elastomeric body 203. The annular channel 225 in this embodiment is essentially V-shaped in a plane perpendicular to the channel, although in some variations of this embodiment, the channel may be C-shaped or U-shaped in cross-section.

Figure 3:
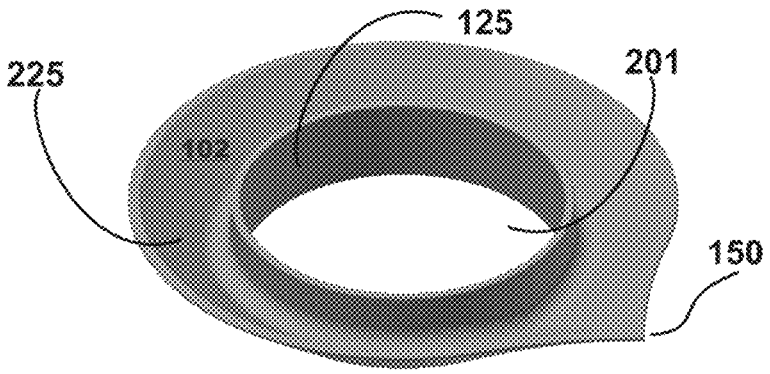
FIG. 3 is an isometric view of the embodiment of FIG. 2.

As best seen in FIG. 3, the elastomeric body 203 is equipped with a first peripheral lip 225 which is adjacent to the central aperture 205. The first peripheral lip 225 forms an inner seal where the elastomeric material of the elastomeric body 203 contacts the skin of the user. Preferably, the central aperture 205 is suitably sized such that the resulting seal is sufficiently tight to prevent most or all perspiration or liquid from passing the contact area.

Figure 4:
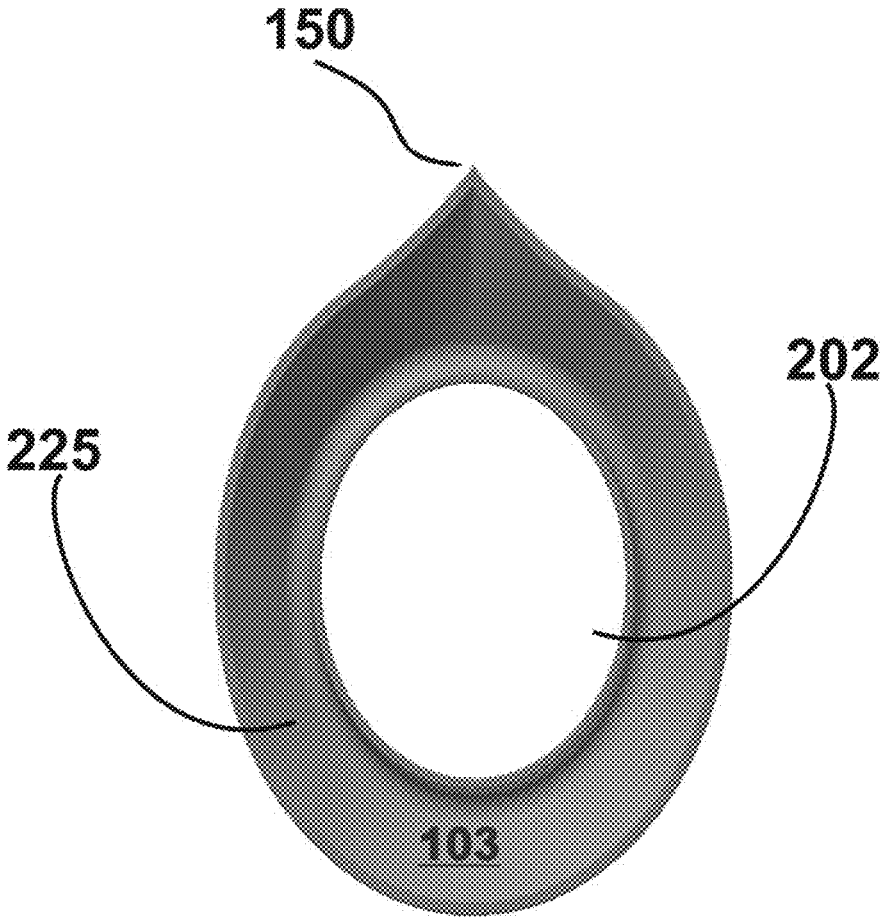
FIG. 4 is a top view of a variation of the embodiment of the type depicted in FIG. 2 in which the hole in the center of the band matches the general shape of the wrist.

FIG. 4 illustrates a variation of the sweat deflector/channeling device 201 of FIGS. 2-3. This embodiment is similar in most respects to the embodiment of FIG. 3. However, while the central aperture 205 in the embodiment of FIGS. 2-3 is circular, the central aperture 305 in the embodiment of FIG. 4 is elliptical. In some applications, this shape may better match the general cross-sectional shape of the user's wrist or angle, thus providing a more complete seal.

Figure 5A:
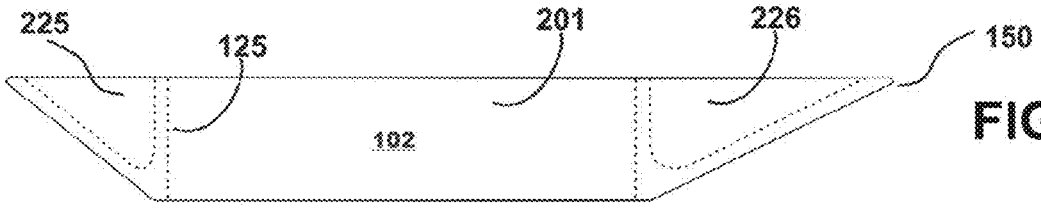
FIGS. 5A and 5B are cross-sectional illustrations taken, respectively, along LINE 5A-5A and 5B-5B of FIG. 2A.
Figure 5B:
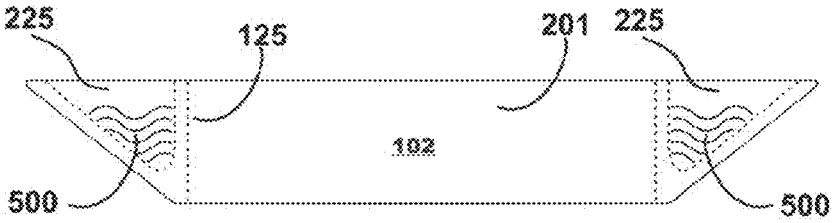

FIGS. 5A and 5B illustrate the cross-sectional geometry of the device 201 of the device of FIGS. 2A and 2B. As seen therein, the annular channel 225 of the device 201 forms a reservoir which entraps sweat from the body of the user while the reservoir is in a vertical direction. FIG. 5A shows the reservoir empty, and FIG. 5B shows the reservoir partially filled. As the reservoir tilts (due to the motion of the body of the user), the accumulated sweat is directed out of the protrusion 207 via longitudinally extending channel 224.

Figure 6:
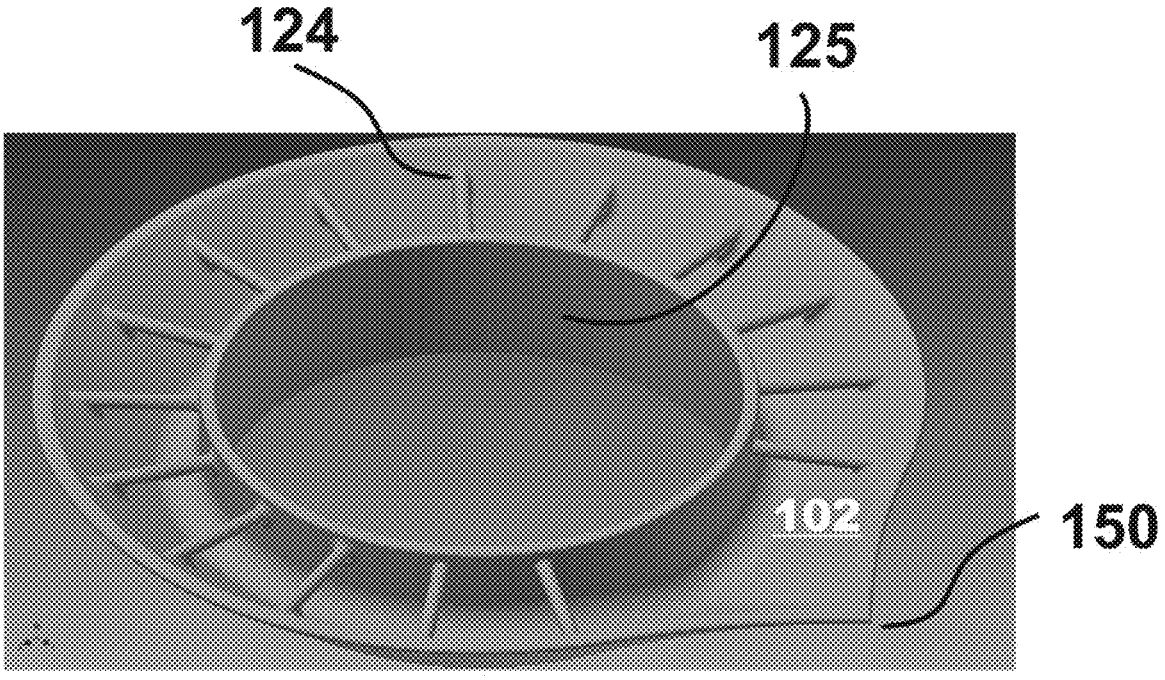
FIG. 6 is an isometric view of a variation of the embodiment of FIG. 2 which is equipped with connected bracing spokes.
Figure 7:
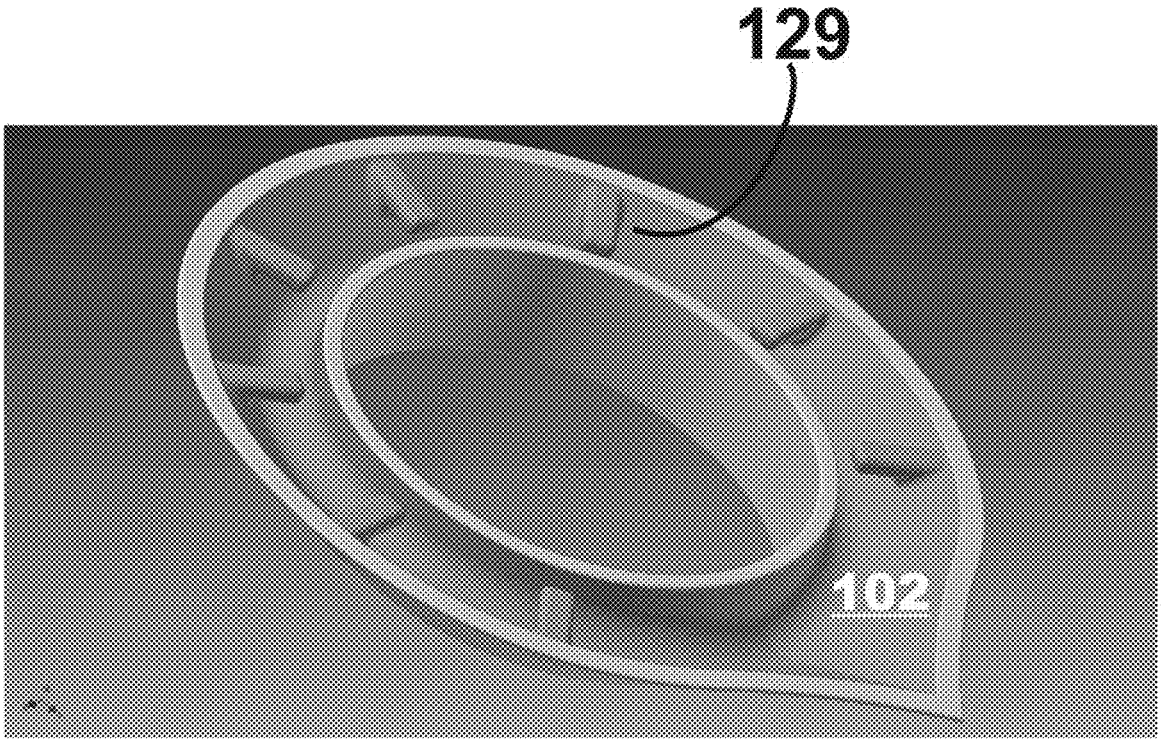
FIG. 7 is an isometric view of a variation of the embodiment of FIG. 2 equipped with un-connected bracing spokes.

FIG. 6 illustrates a further embodiment of a sweat deflector/channeling device of the type disclosed herein. The device 401 depicted therein is similar in most respects to the device of FIGS. 2-3, but is further equipped with a plurality of support elements 431 or struts which extend across the annular channel 425. These support elements help the device 401 maintain its general shape, even if it is stretched across the body of a user. As seen in the similar device 501 depicted in FIG. 7, in some embodiments, the support elements 531 may only extend partially across the annular channel 425.

Figure 8:
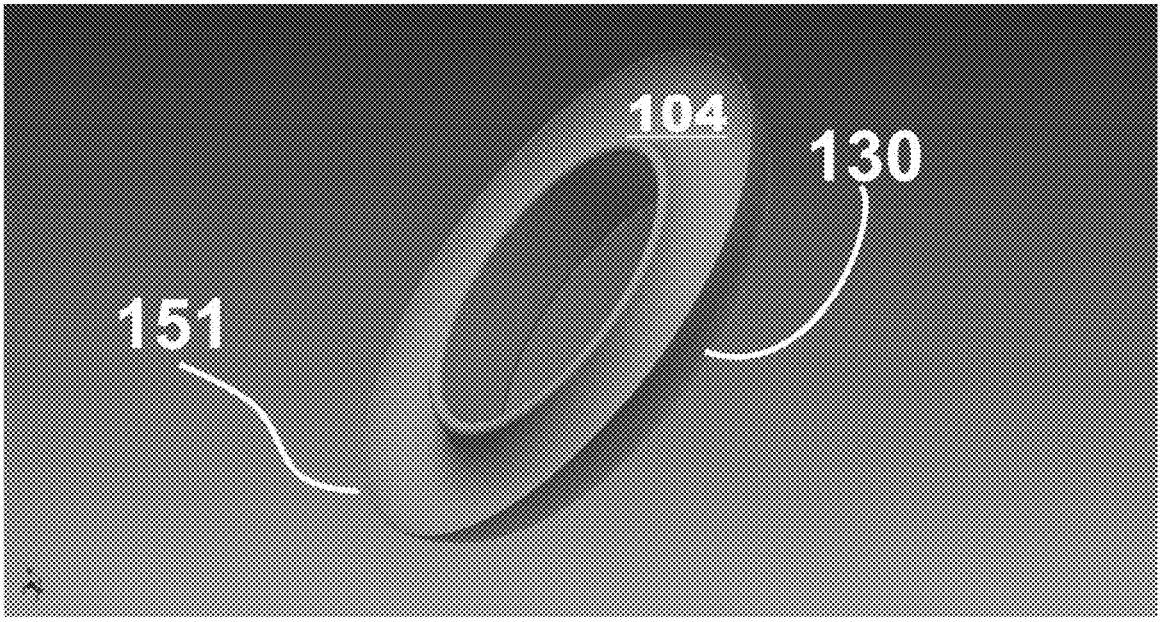
FIG. 8 is an isometric view of a third embodiment of a wrist band in accordance with the teachings herein.

FIG. 8 illustrates a further embodiment of a sweat deflector/channeling device 601 in accordance with the teachings herein. The device of FIG. 8 is similar in most respects to the device 201 of FIGS. 2-3, but lacks the protrusion 207 of that device.

Figure 9:
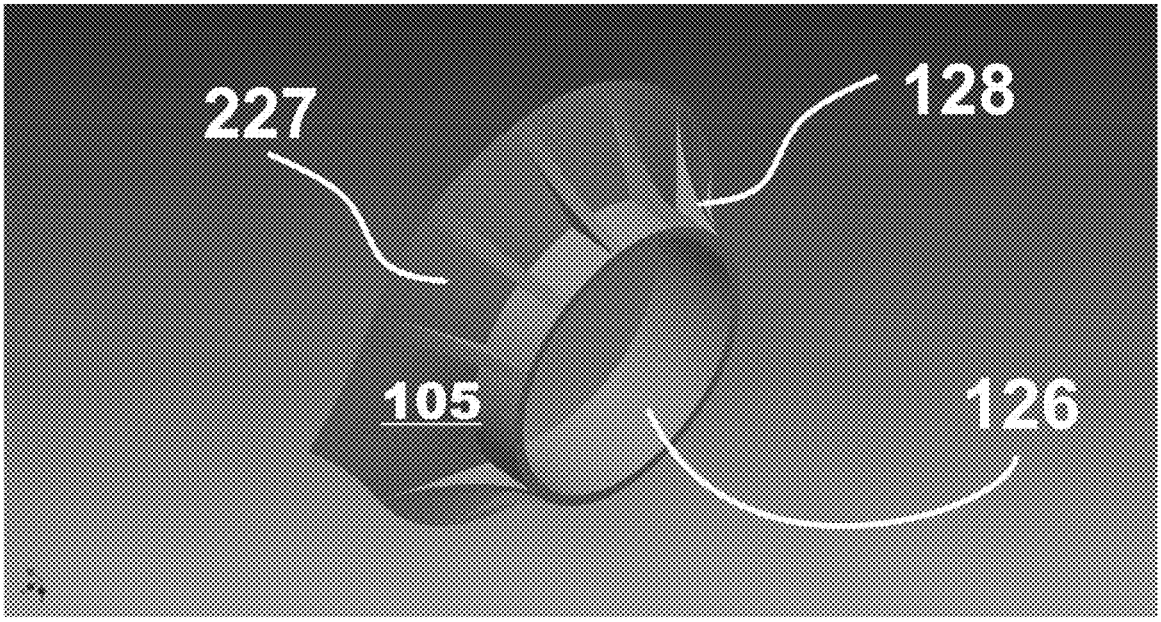
FIG. 9 is an isometric view of a fourth embodiment of a wrist band in accordance with the teachings herein.
Figure 10A:
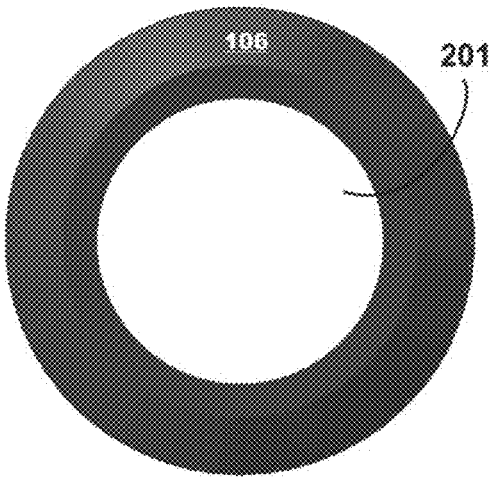
FIGS. 10A, 10B and 10C are, respectively, top, side and isometric views of a fifth embodiment of a wrist band in accordance with the teachings herein.
Figure 10B:
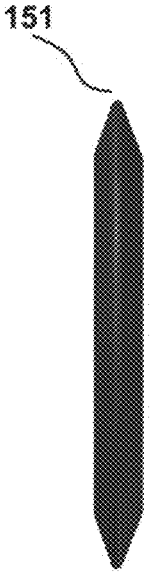
Figure 10C:
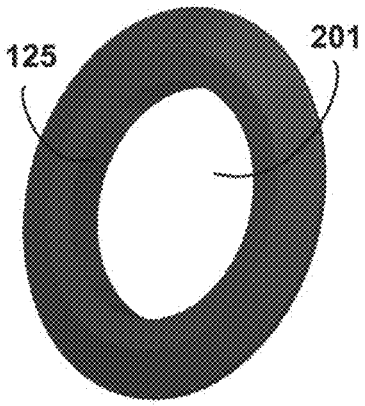
Figure 11:
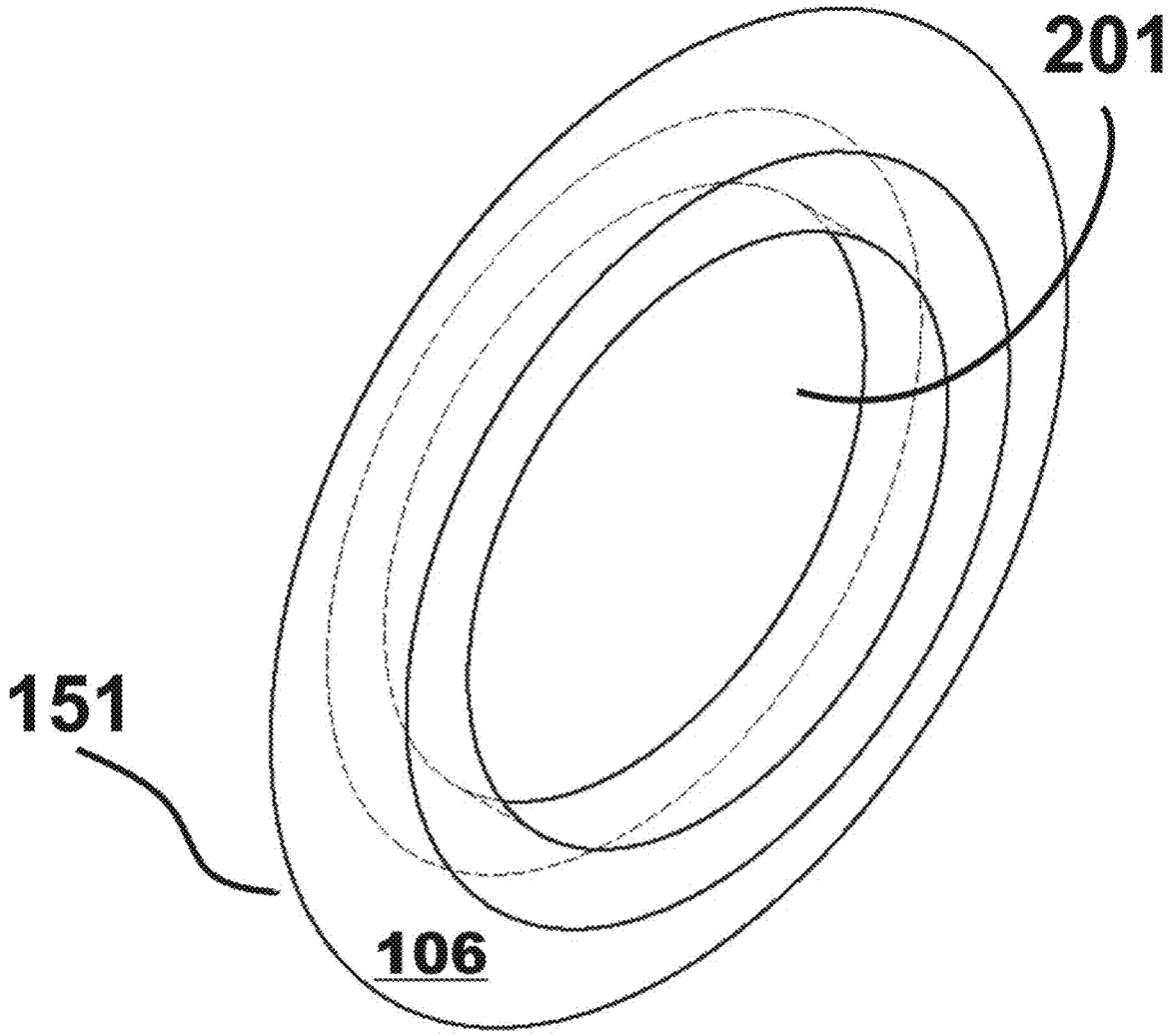
FIG. 11 is a cutaway isometric view of the embodiment of FIG. 10A.

FIG. 9 illustrates a further embodiment of a sweat deflector/channeling device of the type disclosed herein. The device 701 depicted therein is equipped with a plurality of radially extending support elements 728. Unlike the embodiment of FIGS. 2-3, in this embodiment, the reservoir 725 for accumulating sweat is created between the skin of the user and the cupped portion 727 of the elastomeric body 705. Moreover, in the device of FIG. 9, the inner seal 726 does not form part of the reservoir, but is located below it.

FIGS. 10A-C and 11 illustrate a further embodiment of a sweat deflector/channeling device of the type disclosed herein. The device 801 depicted therein is in the form of an elastomeric ring that deflects and redirects perspiration to the peripheral lip thereof. As with the previous embodiments, the central aperture 805 in this device 801 is preferably sized such that the elastomeric body 803 contacts the skin of the user with sufficient tightness to ensure that most or all perspiration or liquid cannot pass the contact area.

Figure 12:
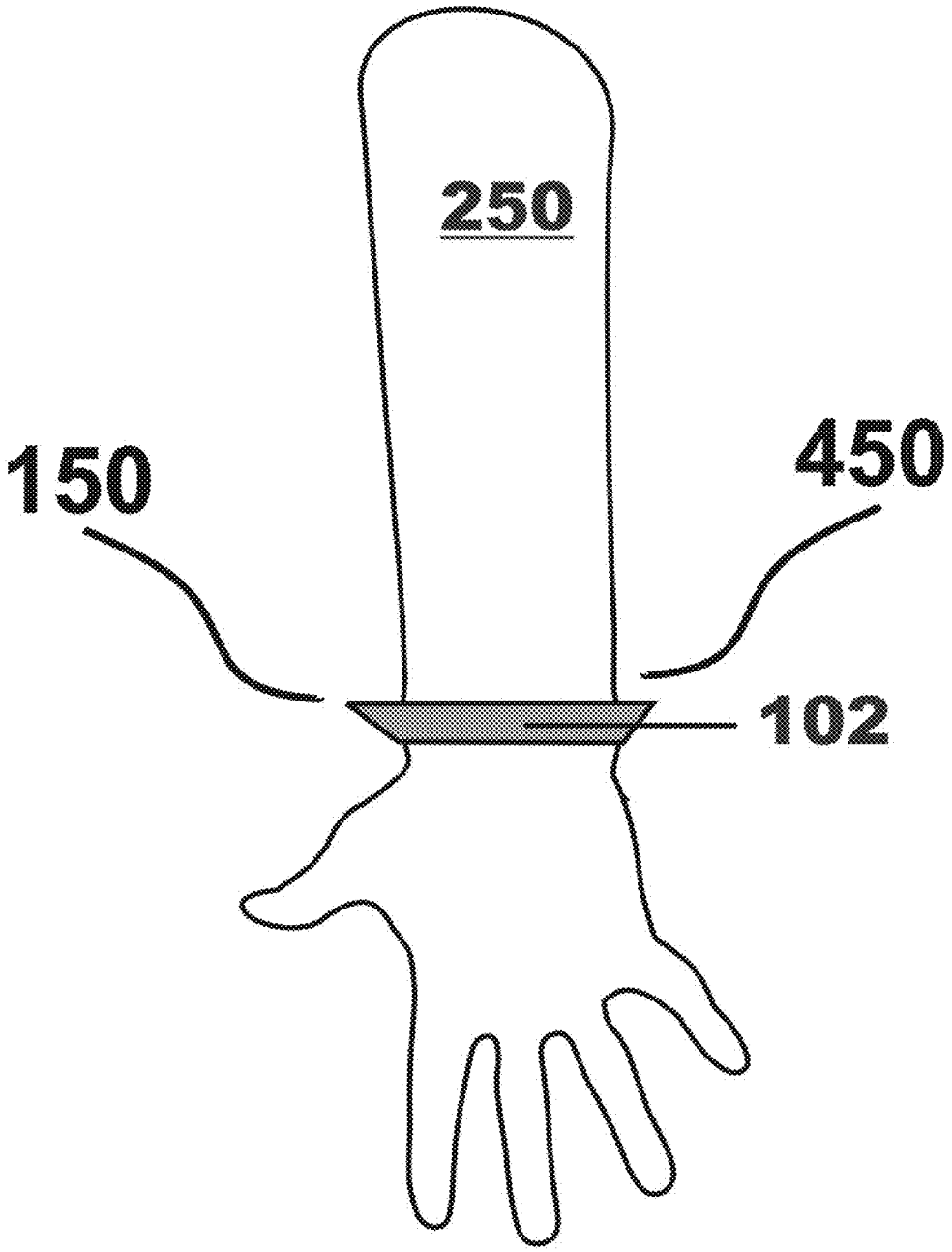
FIG. 12 is a side view of the wrist band of FIG. 2, shown in a facing up (in channel) position on the arm of a user.
Figure 13:
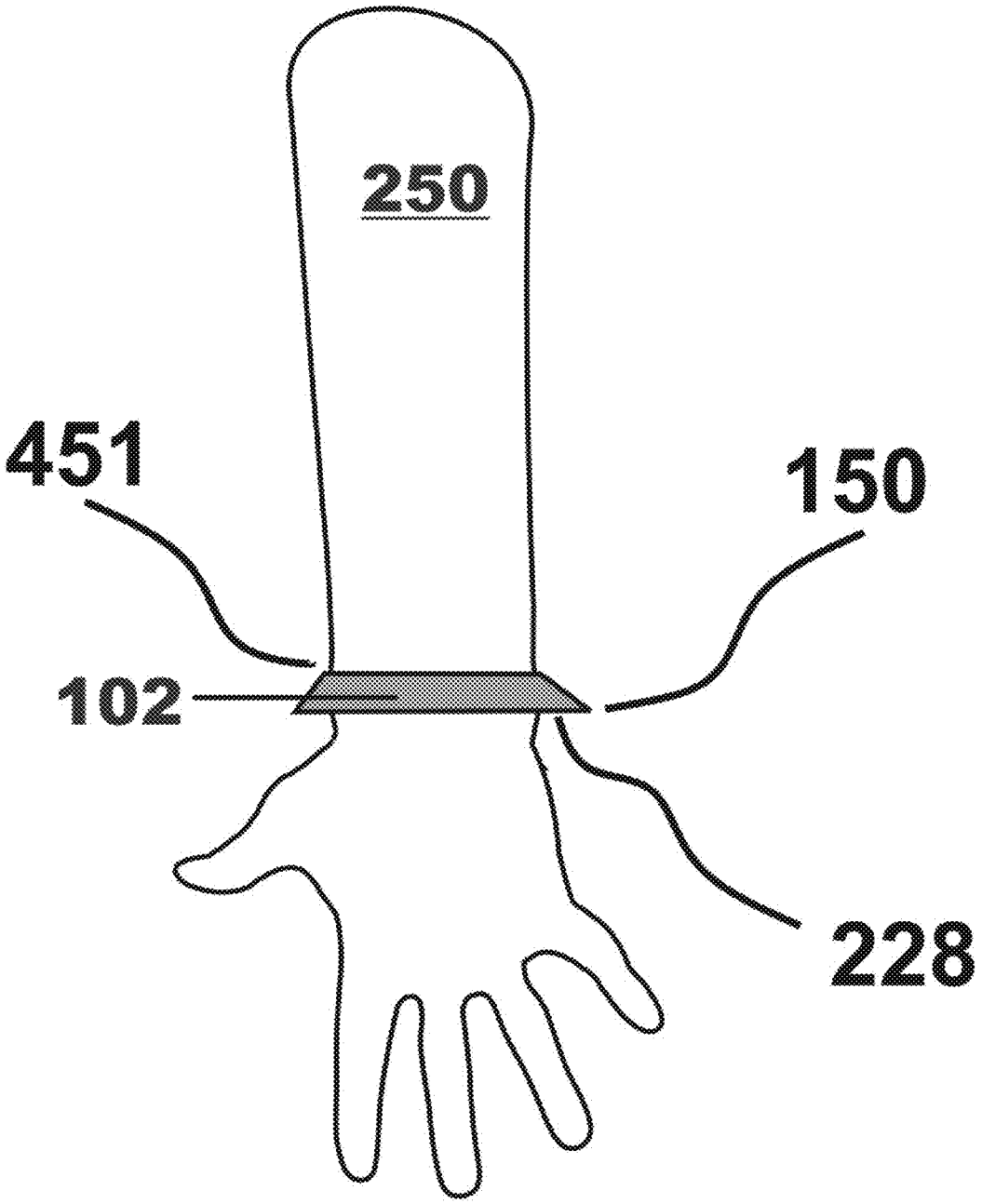
FIG. 13 is a side view of the wrist band of FIG. 2, shown in a facing down (in deflector) position on the arm of a user.
Figure 14:
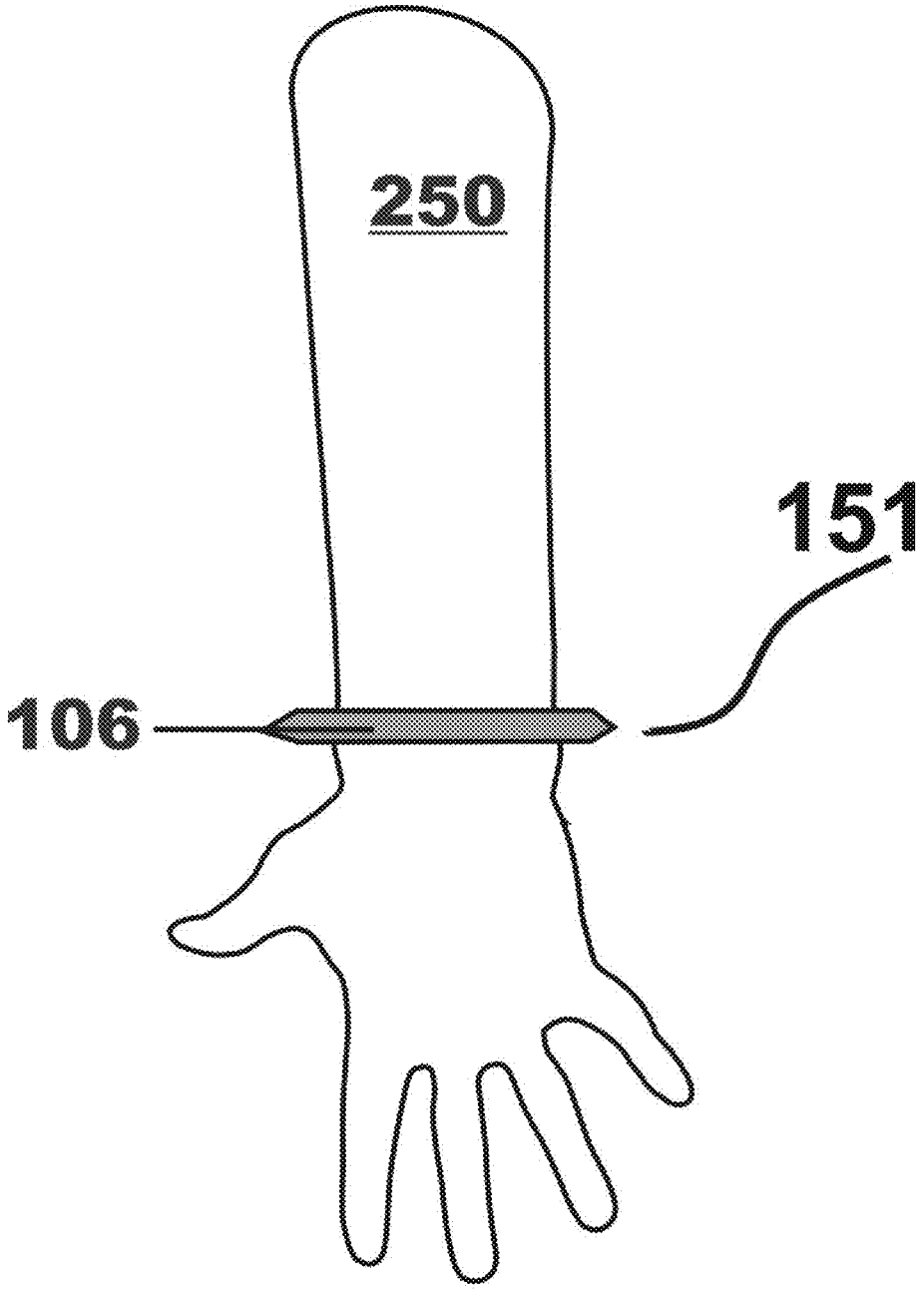
FIG. 14 is a side view of the wrist band of FIG. 10, shown in a facing down position on the arm of a user.
Figure 15:
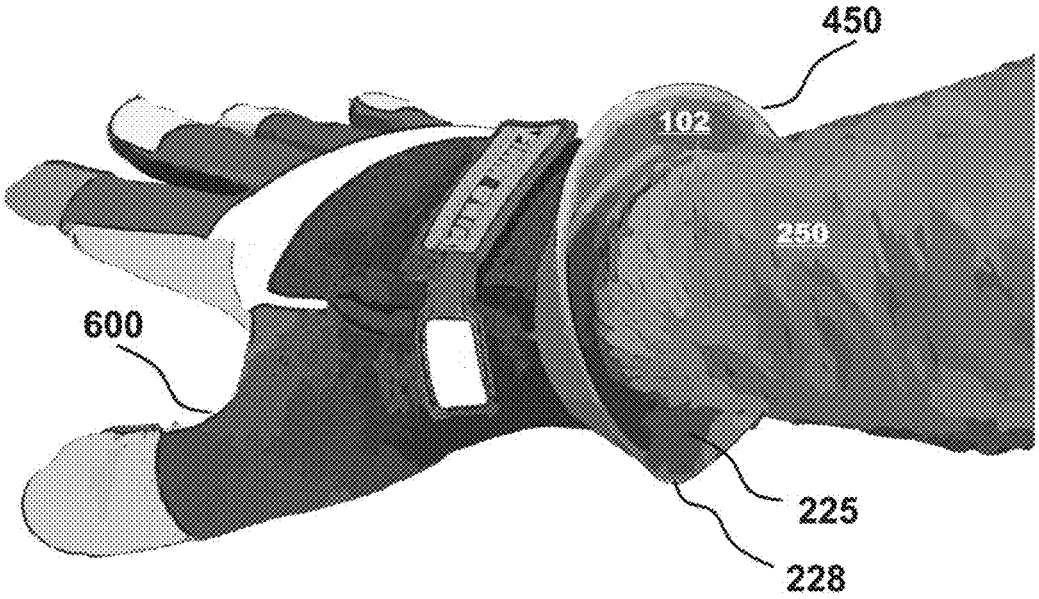
FIG. 15 is an isometric view of a sixth embodiment of a wrist band in accordance with the teachings herein, and in which an elastomeric body is attached to a glove worn by a user.
Figure 16:
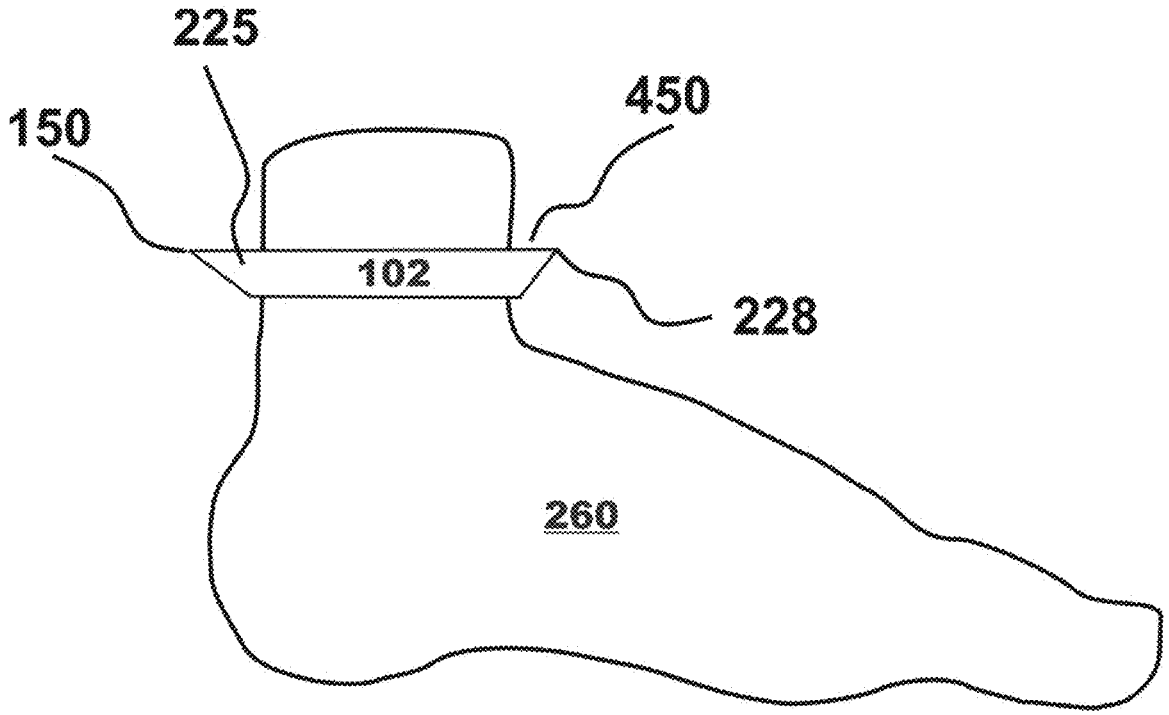
FIG. 16 is a side view of the embodiment of FIG. 2 depicted in a facing up (in channel) position on the leg of a user.

FIG. 12 illustrates a side view of the device 201 of FIGS. 2A-B and 3 on the wrist of a user (FIG. 14 illustrates a similar deployment for the device 801 of FIG. 10, and FIG. 15 illustrates the deployment of the device 201 of FIGS. 2A-B and 3 on the ankle of a user). As seen therein, the device 201 is positioned such that it captures perspiration in the reservoir 225 before being discharged via the longitudinally extending axis 224 of the protrusion 207 (see FIG. 2A). In some applications, the device 201 may be positioned in the opposing orientation, as shown in FIG. 13.

As seen in FIG. 15, in some embodiments, the device 201 of FIGS. 2-3 may be employed in conjunction with, or incorporated into, a glove 1001.

Figure 17:
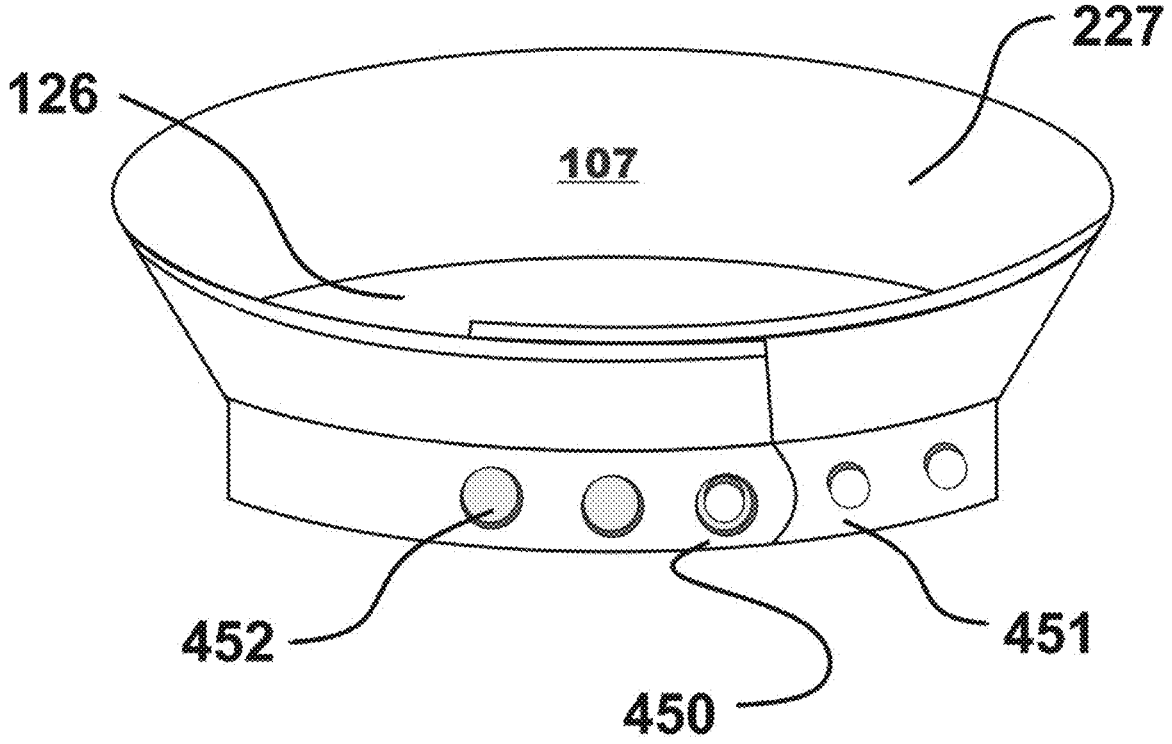
FIG. 17 is an isometric view of a seventh embodiment of a wrist band equipped with an elastomeric or polymeric body which is adjustable in length.

As seen in FIG. 17, in some embodiments, the sweat deflector/channeling device 1101 may be equipped with suitable means to allow the diameter of the central aperture 1105 to be adjusted. In the particular embodiment depicted, a series of apertures 1141 and protrusions 1143 are used for this purpose, although various other adjusting means may be utilized to similar end. These include, without limitation, the use of releasable or repositionable fasteners such as, for example, hook-and-loop type fasteners.

The following video reference links are provided for a further understanding of the devices and methodologies disclosed herein. These include an overview of these devices and methodologies (https://www.youtube.com/watch?v=p9Po0ci1tBg), a video explaining the liquid retention and release (https://www.youtube.com/watch?v=cVliTpiNirg), the use of an embodiment of the devices disclosed herein in removing sweat from the user's brow (https://www.youtube.com/watch?v=akO1huPXsyA), and the use of an embodiment of the devices disclosed herein as a throwing (Frisbee-like) toy (https://youtube/De5xtjEcmB4).

The devices disclosed herein may comprise various materials. Preferably, however, these devices comprise elastomeric materials such as, for example, natural rubber, butyl rubber, nitrile rubber, neoprene, silicones, polyurethanes, and styrene-butadiene. These materials may be provided with suitable fillers, UV stabilizers, fire retardants, dyes, pigments, foaming agents, slip resistant materials, and other such additives. Preferably, the devices disclosed herein are provided with a moisture impermeable surface. In some embodiments, the interior of the device may be porous or foamed to reduce the overall weight of the device.

In some embodiments, the devices disclosed herein may have one or more openings or cavities defined therein for storing one or more items. Such items may include, for example, one or more items selected from the group consisting of keys, money, ID Cards, Health Information cards, holograms, stones, minerals, microchips, keyless entry chips, heart-rate monitors, radios, video displays, GPS devices, Bluetooth devices, biometric reading devices, accelerometers, sweat reading devices, and combinations of two or more of the foregoing.

The present invention is not intended to be limiting and thus be appreciated that various additions, substitutions and modifications may be made to create other specific forms without departing from its scope or essential characteristics. The described embodiments are to be considered in all respects only as illustrative and not restrictive. Individual elements or features of a particular embodiment are generally not limited to that particular embodiment, but, where applicable, are interchangeable and can be used in a selected embodiment, even if not specifically shown or described. All changes which come within the scope and range of equivalency of the appended claims and all such modifications are intended to be included within the scope of the disclosure.

What is claimed is:

1. A wearable device for redirecting perspiration away form a limb of a user, comprising:

a non-moisture absorbent, elastomeric body having first and second opposing major surfaces and having a central aperture defined therein;

a first protrusion extending from said elastomeric body, said protrusion having a first longitudinally extending channel defined therein;

a second, annular channel which is defined in said first major surface and which intersects said first channel;

a first peripheral lip that forms a seal between the elastomeric body and the limb of the user, a plurality of ribs which extend radially across said second channel, extend through said second channel and are spaced apart from said first major surface.

2. The wearable device of claim 1, wherein said elastomeric body is annular in shape.

3. The wearable device of claim 1, wherein said second channel is V-shaped in a cross-section taken in a plane perpendicular to said second channel.

4. The wearable device of claim 1, wherein said second channel is U-shaped in a cross-section taken in a plane perpendicular to said second channel.

5. The wearable device of claim 1, wherein said second channel is C-shaped in a cross-section taken in a plane perpendicular to said second channel.

6. The wearable device of claim 1, wherein said first surface is concave.

7. The wearable device of claim 1, wherein said first surface is convex.

8. The wearable device of claim 1, further comprising a first peripheral lip disposed about the periphery of said central aperture.

9. The wearable device of claim 1, further comprising a plurality of support members which extend radially across and within said second channel.

10. The wearable device of claim 1, further comprising a plurality of support members which extend radially over said second channel.

11. The wearable device of claim 1, wherein said elastomeric body comprises of at least one material selected from the group consisting of neoprene, silicone, and natural rubber.

12. The wearable device of claim 1, wherein said device is adapted to be worn on the limb of a user.

13. The wearable device of claim 1, wherein said device is adapted to be worn on the wrist of a user.

14. The wearable device of claim 1, wherein said device is adapted to be worn on the ankle of a user.

15. The wearable device of claim 1, wherein said central aperture is circular in shape, and wherein said annular channel is concentric with said central aperture.

16. The wearable device of claim 1, wherein said central aperture is elliptical in shape, and wherein the longitudinally extending channel defined in said first protrusion extends along an axis that is perpendicular to said central aperture.

17. The wearable device of claim 16, wherein said second channel is V-shaped or U-shaped in any cross-section taken in a plane perpendicular to said second channel.

18. The wearable device of claim 17, wherein said wearable device has an outer profile having a teardrop shape, and wherein said first protrusion is beak-shaped.

* * * * *